US007470158B2

(12) United States Patent
Ohmori

(10) Patent No.: US 7,470,158 B2
(45) Date of Patent: Dec. 30, 2008

(54) CONNECTING DEVICE

(75) Inventor: Yasuhiro Ohmori, Yao (JP)

(73) Assignee: Hosiden Corporation, Yao-Shi (JP)

( * ) Notice: Subject to any disclaimer, the term of this patent is extended or adjusted under 35 U.S.C. 154(b) by 0 days.

(21) Appl. No.: 11/704,980

(22) Filed: Feb. 12, 2007

(65) Prior Publication Data

US 2008/0026620 A1 Jan. 31, 2008

(30) Foreign Application Priority Data

Jul. 28, 2006 (JP) ..... 2006-205628

(51) Int. Cl.
*H01R 9/12* (2006.01)

(52) U.S. Cl. ..... 439/828

(58) Field of Classification Search ..... 439/828, 439/829, 263, 265, 266
See application file for complete search history.

(56) References Cited

U.S. PATENT DOCUMENTS

| | | | | |
|---|---|---|---|---|
| 1,582,828 | A * | 4/1926 | Kuskin | 439/828 |
| 1,706,659 | A | 3/1929 | Fahnestock | |
| 1,976,312 | A * | 10/1934 | Wachsman | 439/828 |
| 2,075,072 | A * | 3/1937 | Wachsman | 439/828 |
| 3,622,955 | A * | 11/1971 | Fernex | 439/828 |
| 3,915,544 | A | 10/1975 | Yurtin | |
| 3,961,835 | A * | 6/1976 | Huang et al. | 439/828 |
| 4,964,807 | A * | 10/1990 | Draus | 439/169 |
| 6,123,587 | A * | 9/2000 | Beloritski et al. | 439/857 |
| 6,773,313 | B2 * | 8/2004 | Pedrinelli et al. | 439/828 |

FOREIGN PATENT DOCUMENTS

| | | |
|---|---|---|
| EP | 0 813 354 A1 | 12/1997 |
| FR | 2 625 376 A3 | 6/1989 |
| JP | 6-17123 | 3/1994 |
| JP | 9-92018 | 4/1997 |
| JP | 2003-77558 | 3/2003 |
| JP | 2003-168534 | 6/2003 |
| JP | 2005-259370 | 9/2005 |

OTHER PUBLICATIONS

European Search Report dated Dec. 6, 2007.
Japanese Office Action dated Oct. 21, 2008.

* cited by examiner

*Primary Examiner*—Gary F. Paumen
(74) *Attorney, Agent, or Firm*—Kratz, Quintos & Hanson, LLP

(57) ABSTRACT

A connecting device of the present invention includes a contact and a body which accommodates it. Clamp arms of the contact include bent parts, and hold parts continued from the tips of the bent parts and bent opposite to the bent parts. When piece members of the operation member press the bent parts, the hold parts approach each other and intersect to thereby form a space between them. When the press is released, the hold parts approach each other to thereby close the space, whereby the lead terminal inserted in the space is held between the hold parts.

13 Claims, 11 Drawing Sheets

(a)

(b)

CONNECTING DEVICE

The present application claims priority under 35 U.S.C. § 119 of Japanese Patent Application No. 2006-205628 filed on Jul. 28, 2006, the disclosure of which is expressly incorporated by reference herein in its entity.

BACKGROUND OF THE INVENTION

1. Field of the Invention

The present invention relates to connecting devices for electrically connecting lead terminals of electronic devices such as cold cathode fluorescent lamps.

2. Description of the Related Art

As this kind of connecting devices, there is one in which a contact to be accommodated in the body includes a first connection part adapted to elastically hold a lead terminal of an electronic device in between, and a second connection part for connecting to a substrate.

For example, as a first connecting device, there is one as disclosed in Japanese Unexamined Utility Model Publication No. 06-17123, in which a first connection part includes a fixed piece and a curved movable piece having a rectangular hole into which the fixed piece is inserted. The device is adapted such that when the movable piece is press-operated, a space is formed between a wall face of the hole and the fixed piece, so the lead terminal is inserted into the space so as to be held between them.

As a second connecting device, there is one as disclosed in Japanese Unexamined Patent Publication No. 2003-77558, in which a first connection part includes a fixed bracket to be mounted to an accommodation part of the body, and an almost reverse L-shaped movable piece movable vertically with respect to the top end face of the fixed bracket, and an operation member for moving the movable piece. The device is adapted such that when the movable piece is pressed by the operation member, a space is formed between the tip part of the movable piece and the top end face of the fixed bracket, so the lead terminal is inserted into the space so as to be held between them.

As a third connecting device, a first connection part is a coil spring to be accommodated in the body as disclosed in Japanese Unexamined Patent Publication No. 09-92018. The device is adapted such that the coil spring is to be compressed to form a space between one end part of the coil spring and the inner wall face of the body, so the lead terminal is inserted into the space so as to be held between them.

However, the first connecting device has such a configuration that the curved movable piece always abuts an inner wall face of the body. Namely, the elastic force of the movable piece always acts on the body continuously, so the body may be deformed, involving an essential shortcoming that it is not suitable for long-term use.

The second connecting device is adapted to hold the lead terminal between the tip part of the movable piece and the top end face of the fixed bracket, so after the lead terminal is mounted, the elastic force of the movable piece continuously acts on the body through the lead terminal and the top end face of the mounting bracket. Therefore, the second connecting device also has the same shortcoming as that of the first connecting device.

The third connecting device is adapted to hold the lead terminal between an end part of the coil spring and the inner wall face of the body, so after the lead terminal is mounted, the elastic force of the coil spring continuously acts on the body through the lead terminal. Therefore, the third connecting device also has the same shortcoming as that of the first connecting device. Moreover, in forming a space for mounting the lead terminal between one end part of the coil spring and the inner wall face of the body, the coil spring must be compressed by pressing the lead terminal against the coil spring. The elastic force of the coil spring thus causes an unnecessary load applied to the lead terminal when being mounted. Therefore, the device involves another shortcoming that the lead terminal or the electronic device having the lead terminal may be damaged.

SUMMARY OF THE INVENTION

The present invention has been invented in view of the above circumstances. An object thereof is to provide a connecting device adapted such that a load due to the elastic force of a first connection part of a contact is not applied directly to a body, and when mounting a lead terminal, the load is not applied to the lead terminal.

In order to solve the problems discussed above, a connecting device of the present invention includes a contact and a body which accommodates the contact, and the contact includes a first connection part for connecting a lead terminal and a second connection part for connecting a substrate. The first connection part of the contact has first and second clamp arms which are elastically deformable. The first and second clamp arms include: first and second bent or curved parts which are bent or curved in directions away from each other; and first and second hold parts which are continued from the tips of the first and second bent or curved parts and are bent or curved in directions opposite to the first and second bent or curved parts. When the first and second bent or curved parts of the first and second clamp arms are press-operated in directions approaching each other respectively, the first and second hold parts move in directions approaching each other and then intersect to form a space between them for inserting the lead terminal. On the other hand, when the first and second bent or curved parts are released from the press operation, the first and second hold parts move in directions approaching each other so as to close the space, whereby the lead terminal is held between the first and second hold parts.

In the above configuration, elastic forces of the first and second clamp arms are only used for holding a lead terminal, so a load due to the elastic forces of the first and second clamp arms will not be applied directly to the body. Further, the lead terminal is inserted in a space formed between the first and second hold parts, and then, the space is closed and the lead terminal is held between the first and second bent parts or curved parts. Consequently, at the time of mounting the lead terminal, an unnecessary load due to the elastic forces of the first and second clamp arms will not be applied to the lead terminal or the electronic device thereof.

Another connecting device of the present invention includes a contact and a body which accommodates the contact, and the contact includes a first connection part for connecting a lead terminal and a second connection part for connecting a substrate. The first connection part of the contact has a first clamp arm comprising a fixed piece, and a second clamp arm comprising an elastically deformable movable piece. The second clamp arm includes a bent or a curved part which is bent or curved in a direction away from the first clamp arm, and a hold part which is continued from the tip part of the bent or the curved part and is bent or curved in a direction opposite to the bent or the curved part. When the bent or the curved part of the second clamp arm is press-operated toward the first clamp arm, the hold part of the second clamp arm moves in a direction approaching the first clamp arm and then intersects with the first clamp arm so as to form a space between them for inserting the lead terminal. On the other hand, when the bent or the curved part is released from the press operation, the hold part moves in a direction approaching the first clamp arm so as to close the space, whereby the lead terminal is held between the hold part of the second clamp arm and the first clamp arm.

In this configuration, the elastic force of the second clamp arm is only used for holding a lead terminal, so a load due to the elastic force of the second clamp arm will not be applied directly to the body. Further, the lead terminal is inserted in a space formed between the hold part of the second clamp arm and the first clamp arm, and then, the space is closed and the lead terminal is held between the hold part of the second clamp arm and the first clamp arm. Consequently, at the time of mounting the lead terminal, an unnecessary load due to the elastic force of the second clamp arm will not be applied to the lead terminal or the electronic device thereof.

It is preferable that the body includes a main body part for accommodating the contact, and an operation member which is provided movably on the main body part and, in accordance with movement thereof, presses the bent part or the curved part. In this case, the clamp arms can be press-operated easily by only move-operating the operation member.

If the contact has two first clamp arms mentioned above, the two first clamp arms may be disposed on the both sides of the second clamp arm. Alternatively, if the contact has two second clamp arms mentioned above, the two second clamp arms may be disposed on the both sides of the first clamp arm.

In this way, the lead terminal can be held stably by holding the lead terminal between three points of the two first clamp arms and one second clamp arm, or between three points of the two second clamp arms and one first clamp arm.

The body may include an opening allowing the second connection part of the contact to protrude so as to to contact a circuit pattern of the substrate, and an engaging claw which is provided at an opening edge part and extends toward a protruding direction of the second connection part for engaging with the substrate.

In this case, when the engaging claw is engaged with the substrate, the second connection part of the contact contacts the circuit pattern of the substrate and is electrically connected. Therefore, the contact can be electrically connected with the substrate easily.

It is preferable that the second connection part of the contact be in such a shape as to elastically contact the circuit pattern of the substrate. By bringing the second connection part into elastic contact with the circuit pattern in this way, stable electrical connection can be realized.

If a through hole is formed in the substrate, the second connection part of the contact may be linearly shaped as to be inserted into the through hole of the substrate. Alternatively, the second connection part of the contact may be in such a shape as to pressure-bond a lead wire thereto in order to be connectable to the substrate through the lead wire.

According to the the present invention, the connecting device is adapted such that a load due to the elastic forces of clamp arms will not be applied directly to the body, so it is suitable for long-term use. Further, the device is adapted that an unnecessary load due to the elastic forces of the clamp arms will not be applied to a lead terminal when mounting the lead terminal. Therefore, it is possible to prevent damages on the lead terminal and the electronic device thereof.

BRIEF DESCRIPTION OF THE DRAWINGS

FIG. 1(*b*) is a schematic side view showing a connecting device according to an embodiment of the present invention. FIG. 1(*c*) is a schematic rear view showing a connecting device according to an embodiment of the present invention.

FIG. 2(*b*) is a schematic bottom view showing the device.

FIG. 3(*b*) is a schematic perspective view of the device showing a state where a lead terminal of an electronic device is inserted.

FIG. 6(*b*) is an A-A sectional view of the device showing a state where a lead terminal of an electronic device is inserted.

FIG. 7(*b*) is a B-B sectional view of the device showing a state after the operation member is slide-moved. FIG. 7(*c*) is a B-B sectional view of the device showing a state where a lead terminal of an electronic device is inserted.

FIG. 8(*b*) is a schematic perspective view illustrates a design modification example of the contact of the device and showing a contact having first clamp arm and second clamp arm which are elastically deformable movable pieces. FIG. 8(*c*) is a schematic perspective view illustrates a design modification example of the contact of the device and showing a contact having a first clamp arm which is a fixed piece and a second clamp arm which is an elastically deformable movable piece.

FIG. 9(*b*) is a schematic perspective view illustrates another design modification example of the contact of the device and showing a second connection part which is a hook-shaped body capable of being mounted on a substrate. FIG. 9(*c*) is a schematic perspective view illustrates another design modification example of the contact of the device and showing a second connection part in a shape enabling a lead wire to be press-bonded.

DETAILED DESCRIPTION OF THE PREFERRED EMBODIMENTS

Figure 1:
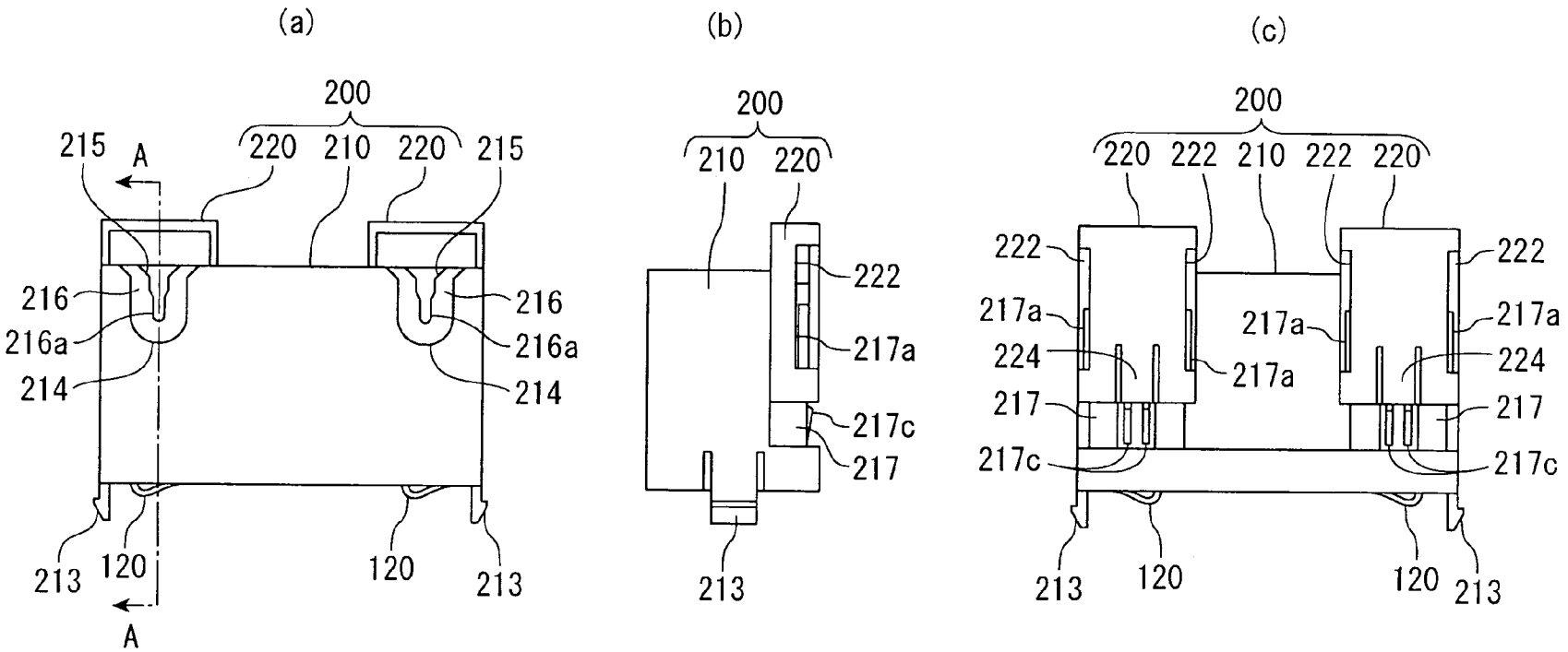
FIG. 1(*a*) is a schematic front view showing a connecting device according to an embodiment of the present invention.

Hereinafter, the preferred embodiments of a connecting device according to an embodiment of the present invention are shown with reference to the drawings attached. The connecting device mentioned here serves as sockets for cold cathode fluorescent lamps 10 not shown and has two contacts 100 for electrically connecting lead terminals 12 of the cold cathode fluorescent lamps (electronic devices) 10 and a substrate 20, respectively, and a body 200 which accommodates the two contacts 100. Detailed explanation will be given below.

Figure 3:
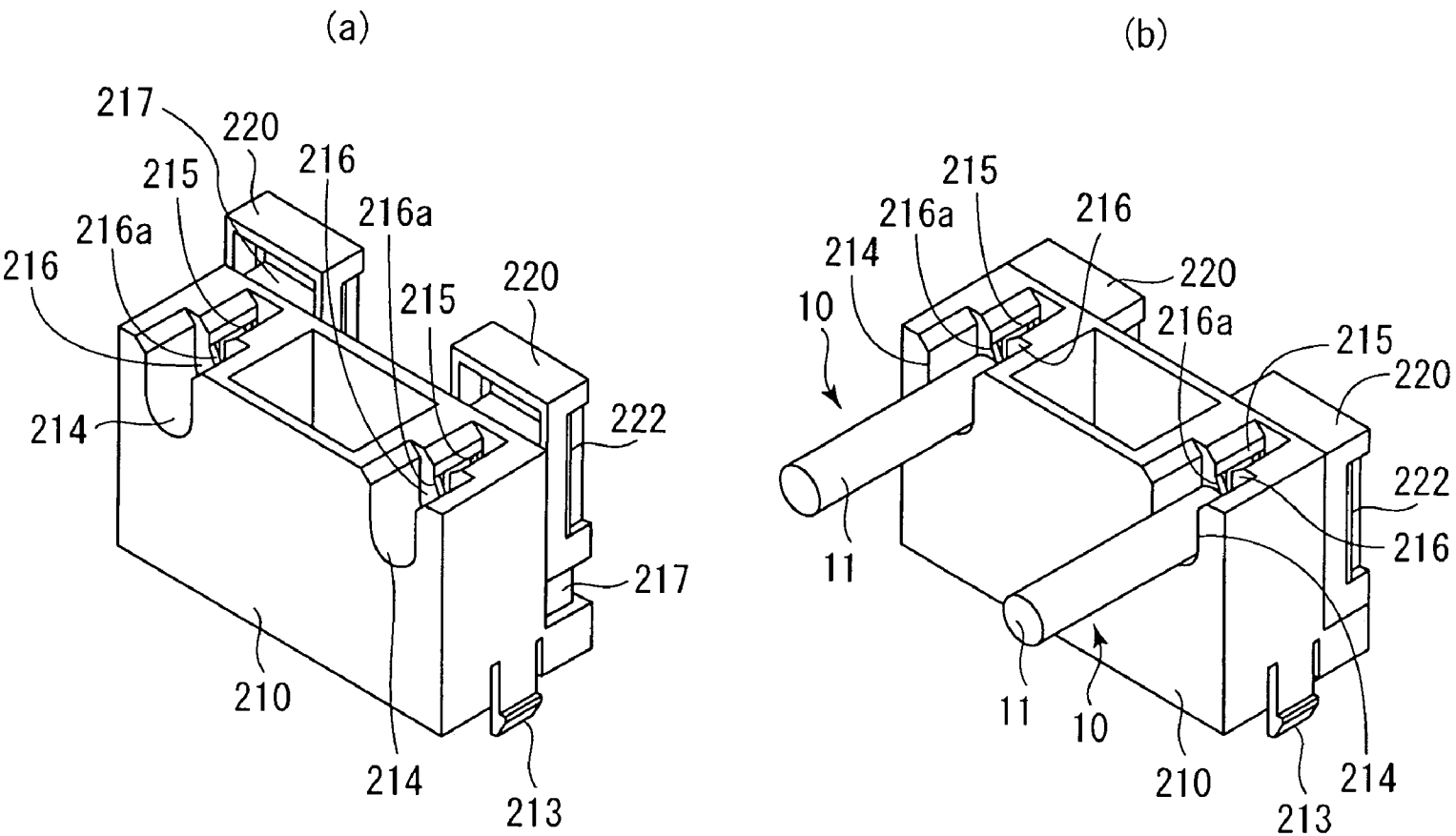
FIG. 3(*a*) is a schematic perspective view of the device showing a state where an operation member is slide-moved.
Figure 4:
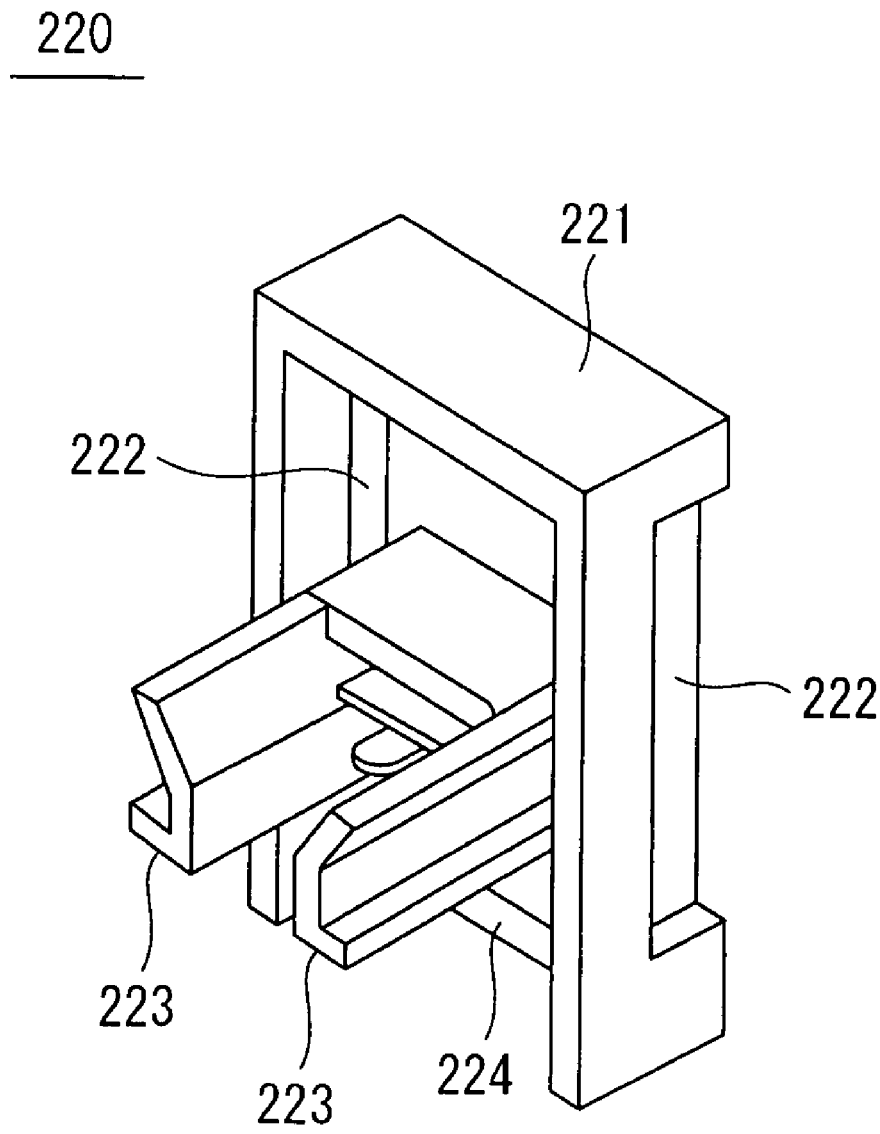
FIG. 4 is a schematic perspective view of the operation member of the device.
Figure 6:
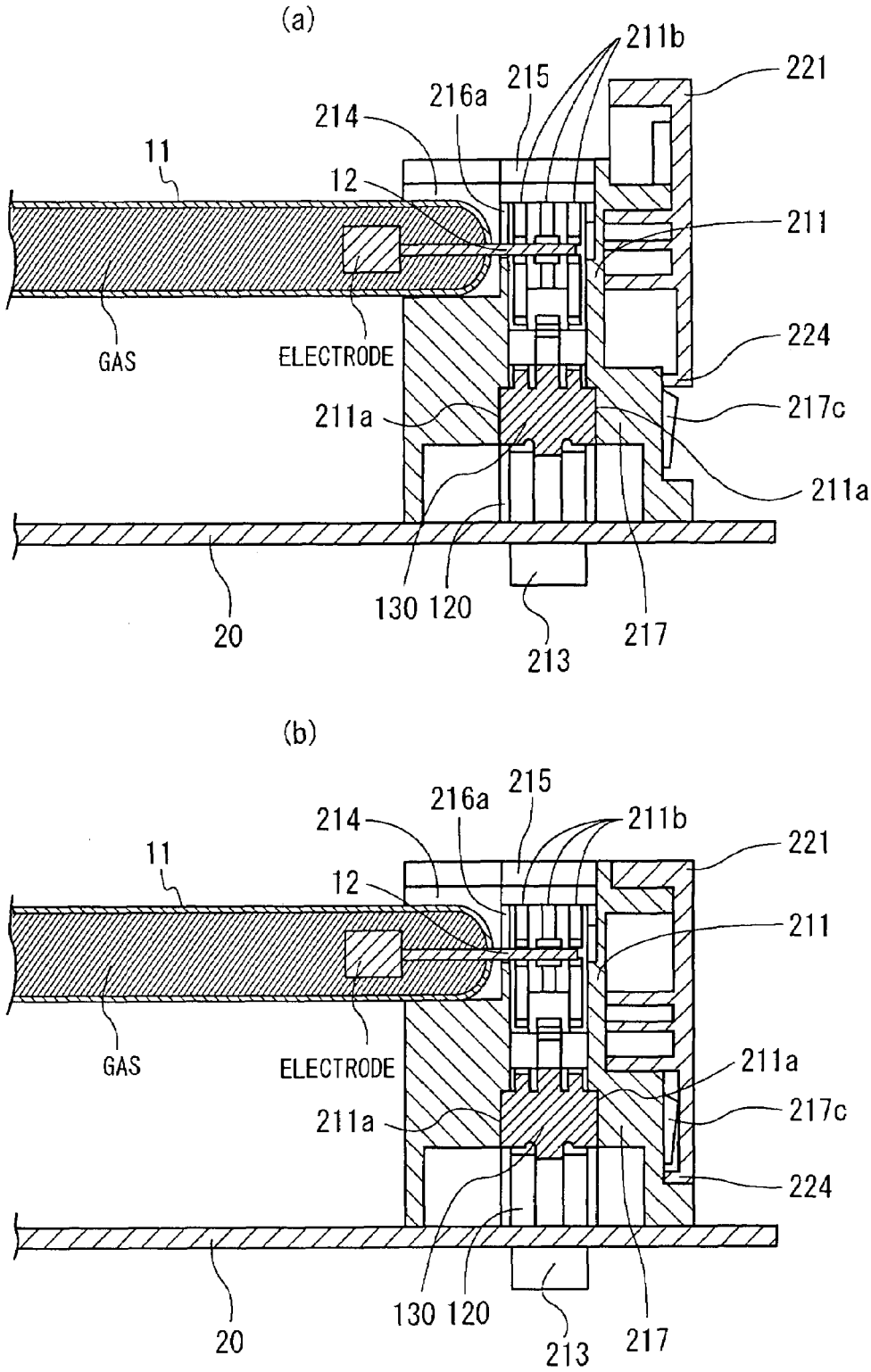
FIG. 6(*a*) is an A-A sectional view of the device showing a state where the operation member is slide-moved.

As shown in FIGS. 3 and 6, a cold cathode fluorescent lamp 10 includes a lamp part 11 and a lead terminal 12 protruding from the lamp part 11.

As shown in FIGS. 1 to 4, the body 200 has a rectangular main body part 210 made of plastic material, and two operation members 220, made of plastic material, attached to the main body part 210 slidably.

Figure 2:
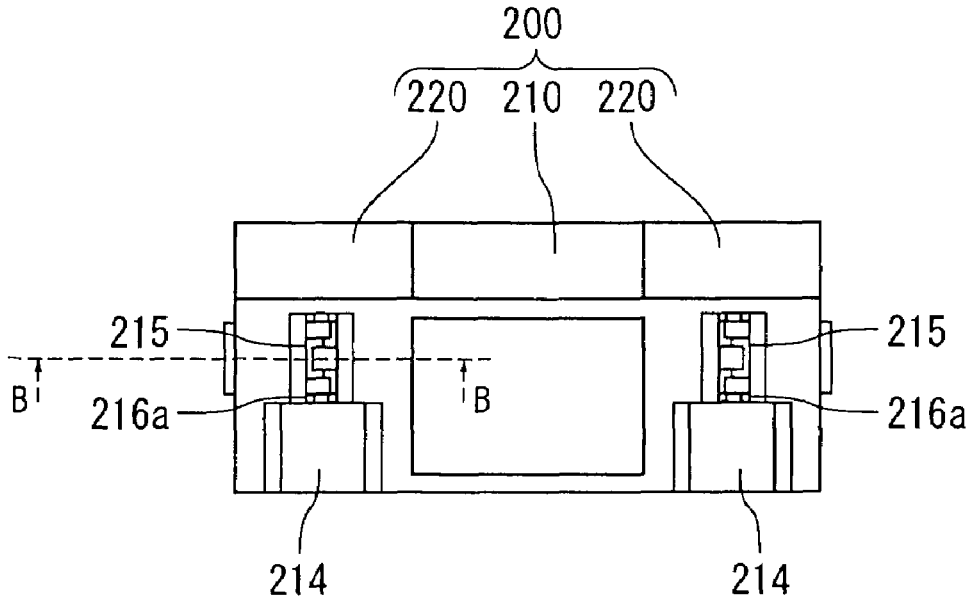
FIG. 2(*a*) is a schematic plan view showing the device.
Figure 2:
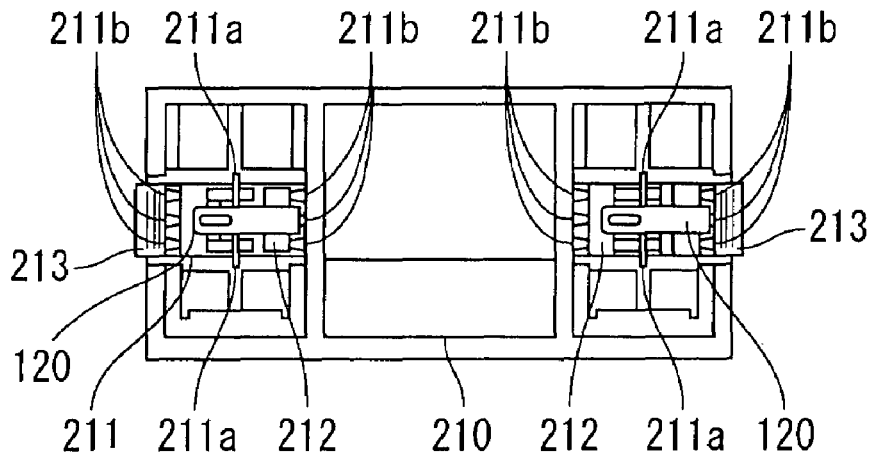

Inside the both end parts in a length direction of the main body part 210, accommodation parts 211 for accommodating the two contacts 100 are provided, as shown in FIGS. 2(*b*), 6 and 7.

Each accommodation part 211 is an almost rectangular space, in which the width dimension is slightly smaller than the width dimension of an intermediate part 130 of the contact 100. As shown in FIG. 2(*b*), in the middle of the both wall faces in the width direction of the accommodation part 211, press-fitting grooves 211*a* are vertically provided, into which the both end parts of the intermediate part 130 of the contact 100 may be press-fitted. Further, on each wall face in a length direction of the accommodation part 211, three projected veins 211*b* are vertically provided at spaced intervals, respectively.

The projected veins 211*b* contact the first and second clamp arms 111 and 112 if the clamp arms are splayed out in directions away from each other due to dimension tolerance. Therefore, the projected veins can prevent interference between the piece members 223 and the first and second clamp arms 111 and 112 when piece members 223 of the operation member 220 are inserted into openings 217*b* of a guide part 217 of the main body part 210.

As shown in FIG. 2(*b*), at each lengthwise opposite end portion of the lower face of the main body part 210, there is provided a rectangular opening 212 formed for releasing the lower end portion of the accommodation part 211 and allowing the second connection part 120 of the contact 100 to protrude downwardly therethrough. The main body part 210 is further provided at each edge portion outside the opening 212 with an engaging claw 213 extending downwardly to engage with an engaging hole, not shown, of the substrate 20 (that is, engaging claw 213 extends in the same direction as the protruding direction of the second connection part 120 of the contact 100).

As shown in FIG. 1(*a*), FIG. 2(*a*) and FIG. 3, at each lengthwise opposite end portion of the upper face of the main body part 210, there is provided a first accommodation groove 214 for removably inserting the lamp part 11 of a cold cathode fluorescent lamp 10 in an up and down direction, a second accommodation groove 215, which continues from the first accommodation groove 214, enabling the lead terminal 12 of the cold cathode fluorescent lamp 10 to be inserted/removed in an up and down direction, and a wall part 216 linking the first and second accommodation grooves 214 and 215.

The second accommodation groove 215 is a groove communicating with the accommodation part 211 and the width dimension thereof is set larger than the width dimension of the lead terminal 12 of the cold cathode fluorescent lamp 10. The both edges in the width direction of the second accommodation groove 215 form tapered faces for guiding the lead terminal 12 into the second accommodation groove 215.

The wall part 216 is a wall-like member linking one lengthwise end of the second accommodation groove 215 and the other lengthwise end of the first accommodation groove 214, in which a slit 216*a* continuing to the second accommodation groove 215 is provided in an up and down direction. The width dimension of the slit 216*a* is set to be slightly larger than the width dimension of the lead terminal 12 of the cold cathode fluorescent lamp 10. The both edges in a width direction of the slit 216*a* form tapered faces for guiding the lead terminal 12. The depth dimension of the slit 216*a* is set to a depth up to the almost same position as a position where the lead terminal 12 is held between the first and second clamp arms 111 and 112 of the contact 100 inside the accommodation part 211. Namely, it is adapted that the lead terminal 12 is held between the first and second clamp arms 111 and 112 of the contact 100 inside the accommodation part 211, and is also supported by the bottom part of the slit 216*a*.

The first accommodation groove 214 is so set that the width dimension thereof is slightly larger than that of the lamp part 11 of the cold cathode fluorescent lamp 10. The depth dimension of the first accommodation groove 214 is set to a depth such that the lamp part 11 of the cold cathode fluorescent lamp 10 is mounted on the bottom part of the first accommodation groove 214 in a state where the lead terminal 12 of the cold cathode fluorescent lamp 10 is supported by the bottom part of the slit 216*a*.

Further, the back face part of the main body part 210 is in such a shape that a part other than the lower end part is cut away in an almost rectangular shape. In the lengthwise opposite end portions of the wall face of the cutaway portion, two guide parts 217 are formed for guiding the operation member 220 slidably in an up and down direction. As shown in FIGS. 1(*c*), 3, 4, 6 and 7, the guide parts 217 are hollow protrusions in an almost rectangular shape, and the inside thereof constitute a part of the accommodation part 211. On the both end faces in a width direction of each of the guide parts 217, a pair of guide protrusions 217*a* are formed. In the both end parts of the front face of the guide part 217, a pair of openings 217*b* are formed, into which a pair of piece members 223 of the operation member 220 are inserted. Further, on the lower center portion of the front face of the guide part 217, a pair of engaging protrusions 217*c* are provided for engaging with the operation member 220.

As shown in FIGS. 1(*b*), 1(*c*), 3, 4, 6 and 7, each operation member 220 includes a movable main body part 221 having the shape of a rectangular box with the bottom being open, a pair of rail grooves 222 formed by cutting the corners of the both end parts in a width direction of the movable main body part 211, a pair of piece members 223 provided between the pair of rail grooves 222 on an inner face of the movable main body part 221, and an engaging piece 224 provided on the lower end part of the movable main body part 221.

In the rail grooves 222, the guide protrusions 217*a* of the guide part 217 are fitted. Thereby, the movable main body part 221 is mounted to the guide part 217 slidably from the initial position (that is, a position where the guide protrusions 217*a* are positioned at the tops of the rail grooves 222) to the pressed position (that is, a position where the guide protrusions 217*a* are positioned at the bottoms of the rail grooves 222).

The engaging piece 224 is protruded at the lower end portion thereof toward the guide part 217, and when the movable main body part 221 is positioned at the initial position, it is engaged with the engaging protrusions 217*c* of the guide part 217.

The top end parts of the pair of piece members 223 form tapered faces between which the spacing decreases gradually. The pair of piece members 223 are inserted in the pair of openings 217*b*, and when the movable main body part 221 is positioned at the pressed position, they press first and second bent parts 111*a* and 112*a* of the first and second clamp arms 111 and 112 of the contact 100 inside the accommodation part 211.

Figure 5:
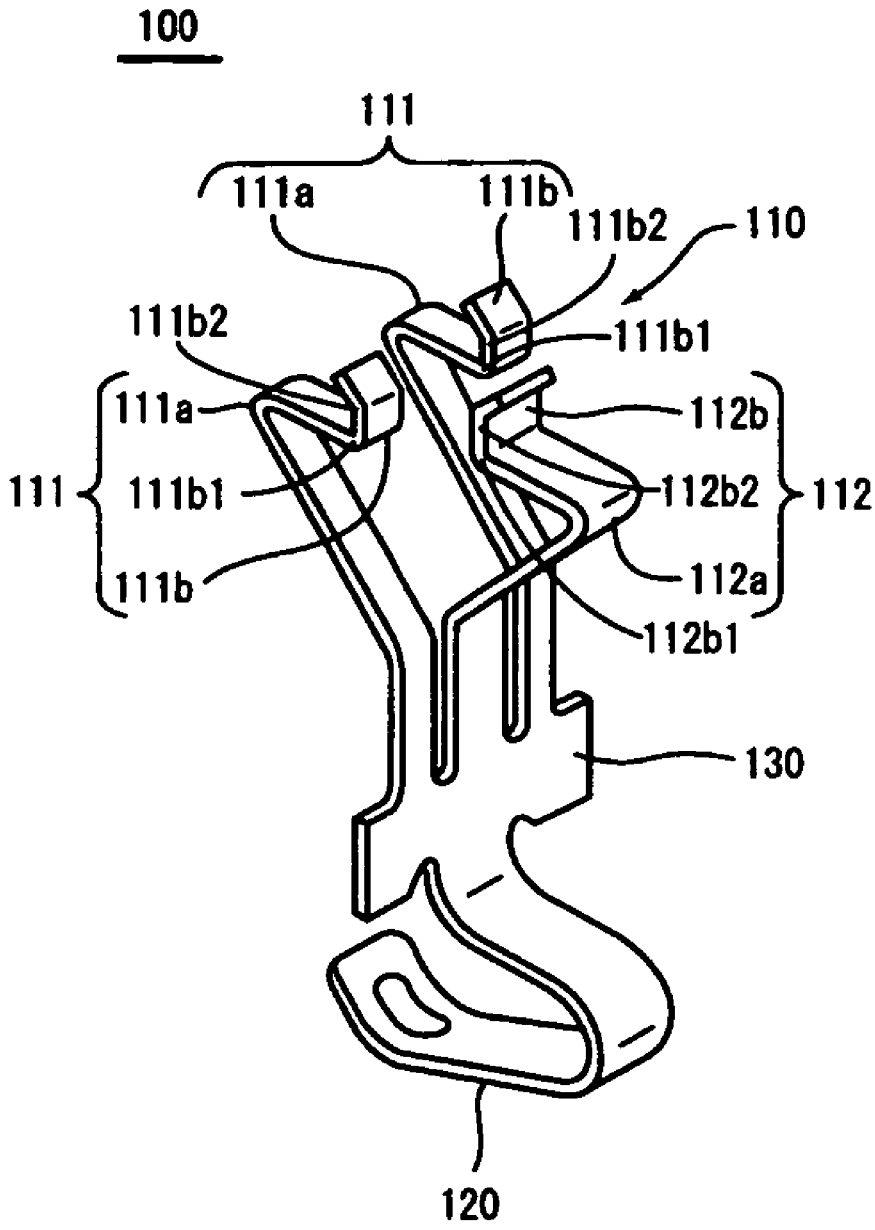
FIG. 5 is a schematic perspective view of a contact of the device.
Figure 7:
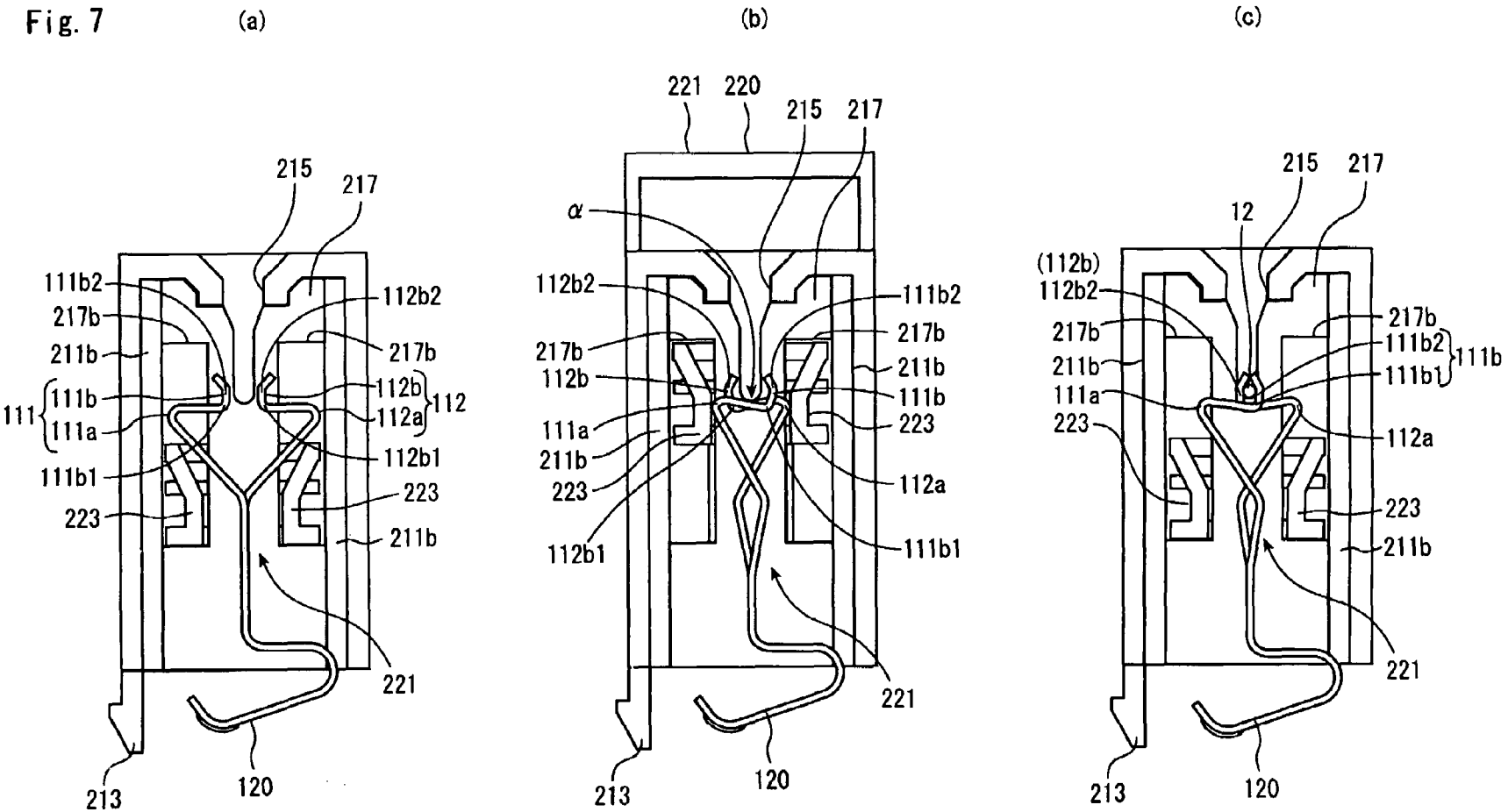
FIG. 7(*a*) is a B-B sectional view of the device showing a state before the operation member is slide-moved.

As shown in FIGS. 5, 6 and 7, each contact 100 is a plate spring having conductivity, including a first connection part 110 for connecting a lead terminal, a second connection part 120 for connecting a substrate, and an intermediate part 130 positioned between the first and second connection parts 110 and 120.

The intermediate part 130 is of a rectangular plate-shaped and has a width dimension slightly larger than the width dimension of the accommodation part 211 of the main body part 210 of the body 200. The both end parts of the intermediate part 130 are press-fitted in the press-fitting grooves 211*a* of the accommodation part 211, whereby the contact 100 is held inside the accommodation part 211.

The second connection part 120 is continued from the lower end of the intermediate part 130 and bent in an almost U shape. As shown in FIG. 1, the height dimension of the second connection part 120 is set enough to protrude from the opening 212 of the main body part 210 of the body 200 in a state where the intermediate part 130 is held inside the accommodation part 211 of the main body part 210 of the body 200 of the contact 100.

The first connection part 110 has two first clamp arms 111, elastically deformable, provided with an interval therebetween on the top end of the intermediate part 130, and a second clamp arm 112, elastically deformable, disposed between the two first clamp arms 111 on the top end of the intermediate part 130.

Each of the first clamp arm 11 has a first bent part 111*a* in an almost L shape, and a first hold part 111*b* which is continued from the tip of the first bent part 111*a* and bent in a direction opposite to the first bent part 111*a*.

The second clamp arm 112 has a second bent part 112*a* in an almost inverse L shape (that is, it is bent in a direction opposite to the first bent part 111*a*), and a second hold part 112*b* which is continued from the tip of the second bent part 112*a* and bent in a direction opposite to the second bent part 112*a*.

As shown in FIG. 7, the first and second bent parts 111*a* and 112*a* are bent such that the bent piece parts continued from the first and second hold parts 111*b* and 112*b* become almost parallel to the substrate 20. The length dimensions of the bent piece parts of the first and second bent parts 111*a* and 112*a* is set such that the bent parts will not intersect with each other in the initial state and when the first and second bent parts 111*a* and 112*a* are pressed by the piece members 223 of the operation members 220, they intersect with each other so as to form a space α for inserting the lead terminal 12 between the hold parts 111*b* and 112*b*.

Hereinafter, assembling procedures of the connecting device of such a configuration will be explained. First, the intermediate part 130 of the contact 100 is positioned to be press-inserted into the press-fitting grooves 211*a* of the accommodation part 211 of the body 200, whereby the contact 100 is accommodated in the accommodation part 211.

Then, the pair of piece members 223 of the operationmember 220 is positioned to be inserted into the pair of openings217*b* of the guide part 217 of the body 200 with care not to contact the first and second bent parts 111*a* and 112*a* of the contact 100 inside the accommodation part 211. Then, when the operation member 220 is pressed against the guide part 217 of the body 200, the both end parts in a width direction of the operation member 220 are elastically deformed and go over the guide part 217 of the body 200. Thereby, the guide protrusions 217*a* of the guide part 217 are fitted in the rail grooves 222 of the operation member 220.

Hereinafter, a using method of the connecting device assembled in this manner will be explained. First, the engaging claws 213 of the body 200 are inserted into engaging holes, not shown, of the substrate 20, and engaged. Then, the second connection parts 120 of the contact 100 protruding from the opening 212 of the body 200 are pressed to a circuit pattern, not shown, of the substrate 200, and elastically contact. Thereby, the contact 100 is electrically connected with the circuit pattern of the substrate 20.

Then, the operation member 220 is moved from the initial position to the pressed position. At this time, the engaging piece 224 of the operation member 220 goes over the engaging protrusions 217*c* of the guide part 217. Then, as shown in FIG. 7(*b*), the pair of piece members 223 of the operation member 220 press the first and second bent parts 111*a* and 112*a* of the first and second clamp arms 111 and 112 of the contact 100, whereby the first and second bent parts 111*a* and 112*a* move in directions approaching each other, and the first and second hold parts 111*b* and 112*b* move in directions approaching each other and basal end portions 111*b*1 and 112*b*1 of the first and second hold parts 111*b* and 112*b* intersect with each other, and then distal end portions 111*b*2 and 112*b*2 of the first and second hold parts 111*b* and 112*b* move in directions away from each other to thereby form the space α between them.

Then, the lamp part 11 of the cold cathode fluorescent lamp 10 is inserted into the first accommodation groove 214 of the body 200, and the lead terminal 12 of the cold cathode fluorescent lamp 10 is inserted in the accommodation groove 215 of the body 200. Thereby, the lead terminal 12 is guided into the slit 216*a* of the wall part 216 of the body 200, and inserted into the space α between the distal end portions 111*b*2 and 112*b*2 of the first and second hold parts 111*b* and 112*b* of the contact 100 inside the accommodation part 211 of the body 200.

Then, the operation member 220 is moved from the pressed position to the initial position. At this time, the engaging piece 224 of the operation member 220 is engaged with the engaging protrusions 217*c* of the guide part 217. Thereby, pressing by the pair of piece members 223 of the operation member 220 to the first and second bent parts 111*a* and 112*a* is released. Then, with return forces of the first and second clamp arms 111 and 112 themselves, the first and second bent parts 111*a* and 112*a* move in directions away from each other, and on the other hand, the distal end portions 111*b*2 and 112*b*2 of the first and second hold parts 111*b* and 112*b* move in directions approaching each other. Thereby, the space α is closed, and the lead terminal 12 inserted in the space α is held between the distal end portions 111*b*2 and 112*b*2 of the first and second hold parts 111*b* and 112*b*. In this way, the lead terminal 12 is electrically connected with the contact 100.

To remove the lead terminal 12, the operation member 220 is moved from the initial position to the pressed position. At this time, the engaging piece 224 of the operation member 220 goes over the engaging protrusion 217*c* of the guide part 217. Then, the pair of piece members 223 of the operation member 220 press the first and second bent parts 111*a* and 112*a* of the first and second clamp arms 111 and 112 of the contact 100, and the first and second bent parts 111*a* and 112*a* move in directions of approaching each other, while the distal end portions 111*b*2 and 112*b*2 of the first and second hold parts 111*b* and 112*b* move in directions away from each other. Thereby, the space α opens, so the holding of the lead terminal 12 between the distal end portions 111*b*2 and 112*b*2 of the first and second hold parts 111*b* and 112*b* is released. Then, the lead terminal 12 is drawn upward from the second accommodation groove 215 of the body 200 or drawn in parallel with the substrate 20.

In the case of the connecting device as described above, the operation member 220 is moved to the pressed position, and by the pressing of the piece members 223 of the operation member 220, the space α is formed between the first and second hold parts 111*b* and 112*b* of the first and second clamp arms ill and 112, and the lead terminal 12 is inserted in the space α. Then, the operation member 220 is moved to the initial position so as to release the pressing by the piece members 223 of the operation member 220 to thereby close the space α, whereby the lead terminal 12 is held between the first and second hold parts 111*b* and 112*b*. Therefore, a load due to the elastic forces of the first and second clamp arms 111 and 112 will not be applied to the body 200, so the connecting device is suitable for use in a long period. Further, to mount the lead terminal 12, it is only necessary to insert the lead terminal 12 in the space α between the first and second hold parts 111*b* and 112*b* and hold it between the first and second hold parts 111*b* and 112*b*, so unnecessary load due to the elastic forces of the first and second clamp arms 111 and 112 will not be applied to the lead terminal 12 or to the lamp part 11. Therefore, it is possible to prevent breakage of the cold cathode fluorescent lamp 10 when mounting which may be caused by the load.

Further, holding of the lead terminal 12 between them and a release thereof can be done by only slide-moving the operation member 220, so mounting and removal of the lead terminal 12 can be done easily. Therefore, it is easy to replace the cold cathode fluorescent lamp 10.

Further, by engaging the engaging claw 213 of the body 200 with the engaging hole of the substrate 20, the second connection part 120 of the contact 100 protruding from the opening 212 of the body 200 is made to elastically contact the circuit pattern of the substrate 20. Therefore, the contact 100 can be connected with the substrate 20 easily without using soldering connection, which results in cost reduction.

Figure 8:
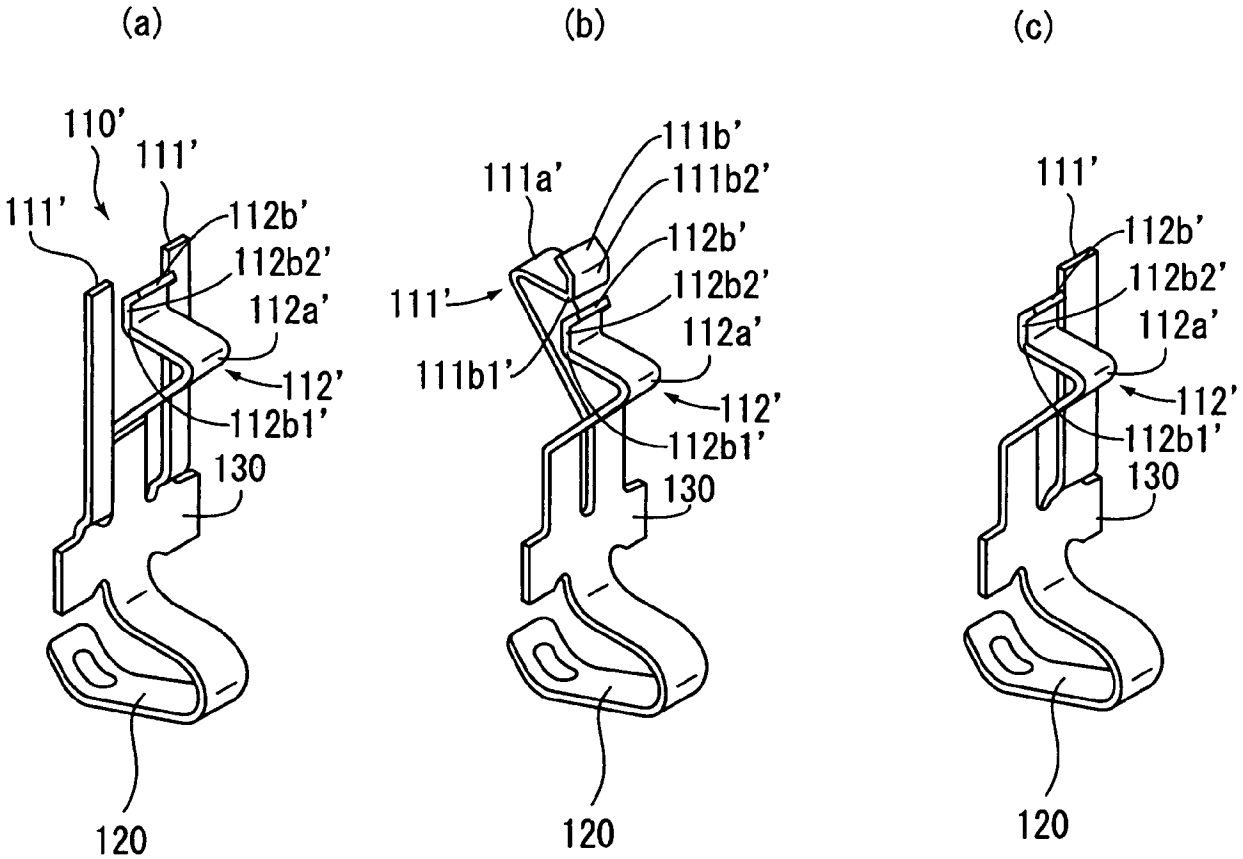
FIG. 8(*a*) is a schematic perspective view illustrates a design modification example of the contact of the device and showing a contact having two first clamp arms which are fixed pieces and a second clamp arm which is a elastically deformable movable piece.

Note that for the first connection part of the contact, any design change is acceptable, provided that the part includes a pair of clamp arms in which at least one of them is a movable piece, and that when a bent part of the movable piece is press-operated, the hold part of the movable piece moves in a direction approaching the other clamp arm so that they intersect with each other to thereby form a space between them for inserting a lead terminal. For example, as shown in FIG. 8(*a*), the first connection part may be so configured as to include two first clamp arms 111', which are plate-shaped fixed pieces, and a second clamp arm 112', which is an elastically deformable movable piece disposed between the first clamp arms. Alternatively, although it is not shown, the first connection part may be so configured as to include two first clamp arms which are elastically deformable movable pieces and a second clamp arm, which is a plate-shaped fixed piece disposed between the first clamp arms. By holding the lead terminal 12 at three points, it can be held stably. Further alternatively, the lead terminal may be held between two points in a configuration as shown in FIG. 8(*b*) including a pair of first and second clamp arms 111' and 112' both of which are elastically deformable movable pieces or, as shown in FIG. 8(*c*), in a configuration including a plate-shaped first clamp arm 111' which is a fixed piece and a second clamp arm 112' which is an elastically deformable movable piece. It is needless to say that four or more clamp arms may be provided.

The first and second bent parts 111*a* and 112*a* and the first and second hold parts 111*b* and 112*b* may be in curved shape. For the first and second bent parts 111*a* and 112*a* and hold parts 111*b* and 112*b*, bent-shaped ones and curved-shaped ones may be combined. Further, although the first and second bent parts 111*a* and 112*a* have been described as being press-operated by the operation member 220, they are not limited to this configuration. An operator may operate the bent parts manually. Specifically, the operator may operate the first and second bent parts 111*a* and 112*a* because they protrude from the body.

Figure 9:
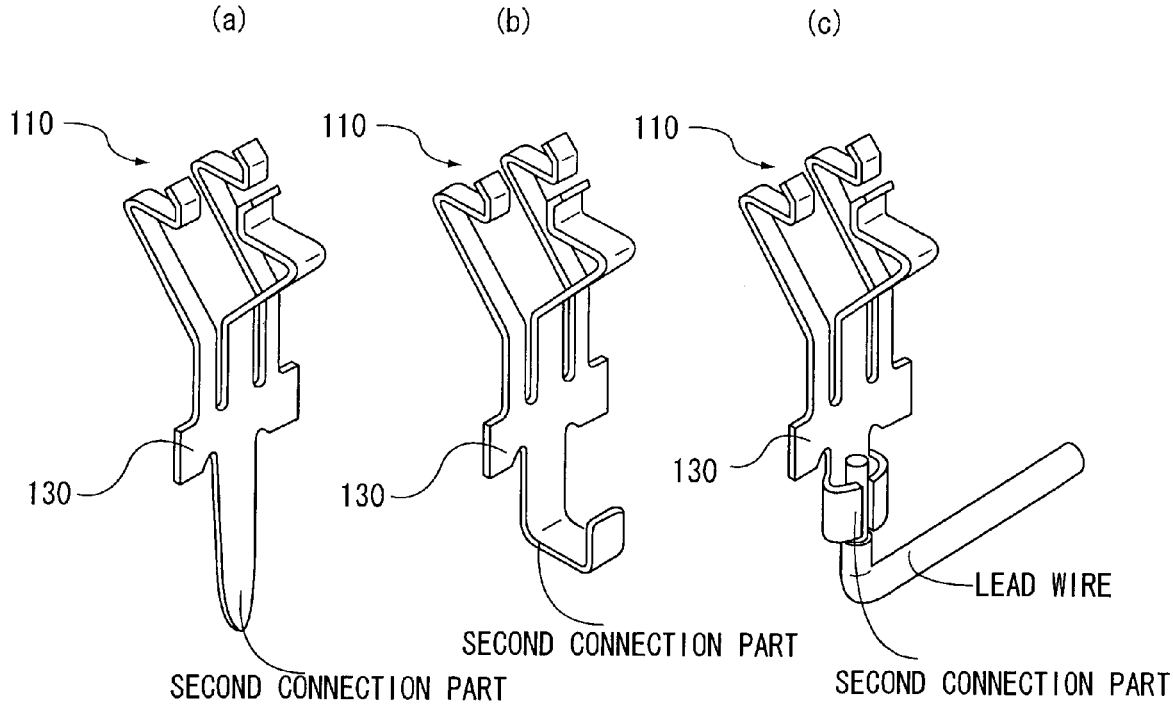
FIG. 9(*a*) is a schematic perspective view illustrates another design modification example of the contact of the device and showing a second connection part which is a plate-shaped body capable of being inserted into a through hole of a substrate.

For the second connection part, any design change is acceptable if it can be electrically connected with the substrate 20. For example, if a through hole is formed in the substrate 20, the second connection part may be a linear plate-shaped body capable of being inserted in the through hole as shown in FIG. 9(*a*), or maybe a hook-shaped body to be brought contact with and be mounted on the circuit pattern of the substrate 20 as shown in FIG. 9(*b*), or may be in such a shape as to press-fit therein a lead wire for connecting the second connection part with the circuit pattern or other electronic components of the substrate 20 as shown in FIG. 9(*c*). Further, it is passable to provide the second connection part 120 as a separate body and contact with the first connection part 120.

Figure 10:
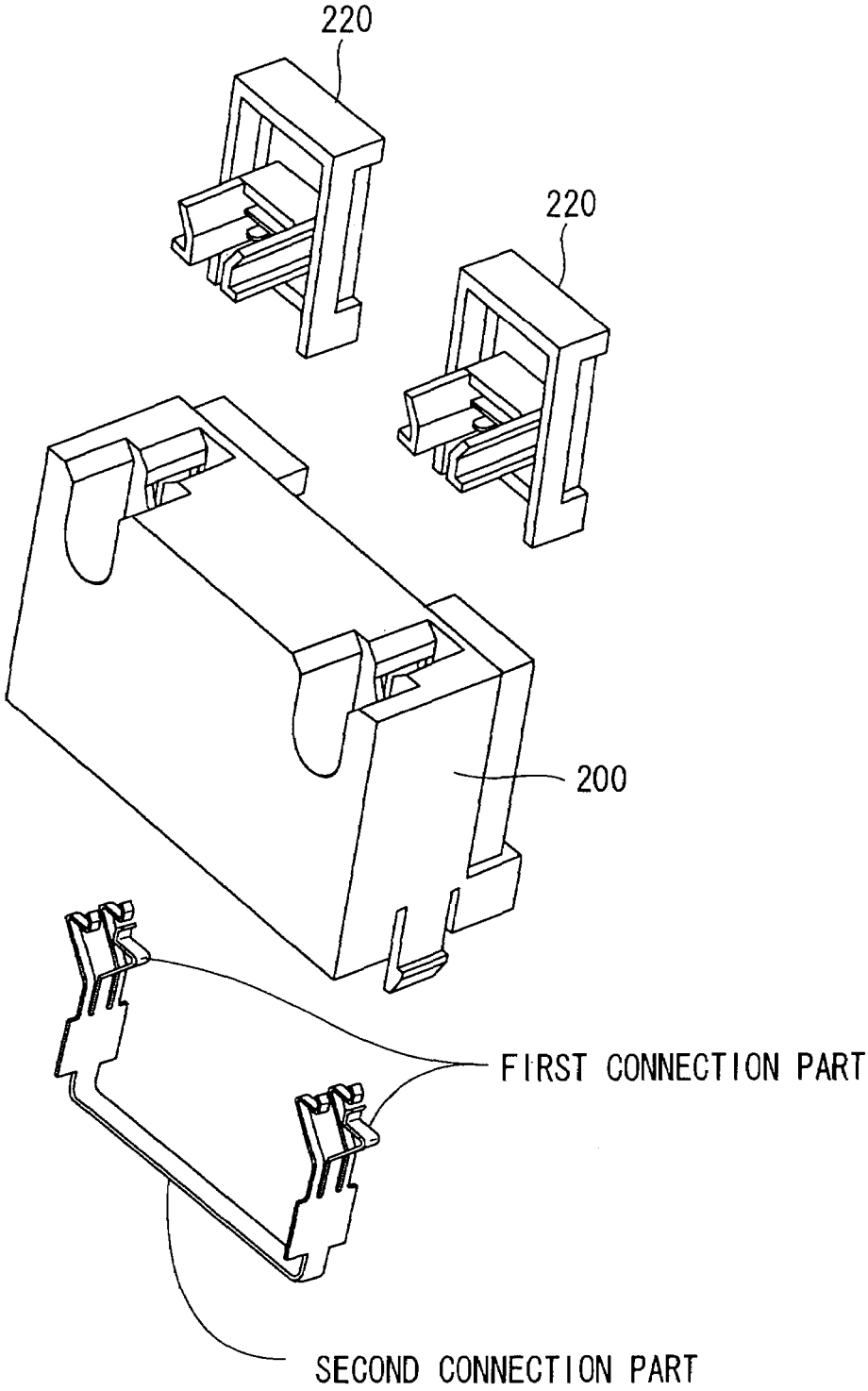
FIG. 10 is a schematic exploded perspective view showing still another design modification example of the contact of the device.

Note that for the contact, it is only necessary to include the first and second connection parts, and any combination thereof is possible. Further, as shown in FIG. 10, it is possible to form the second connection part in an dented shape in a side view and to arrange the first connection parts at the each end thereof.

Figure 11:
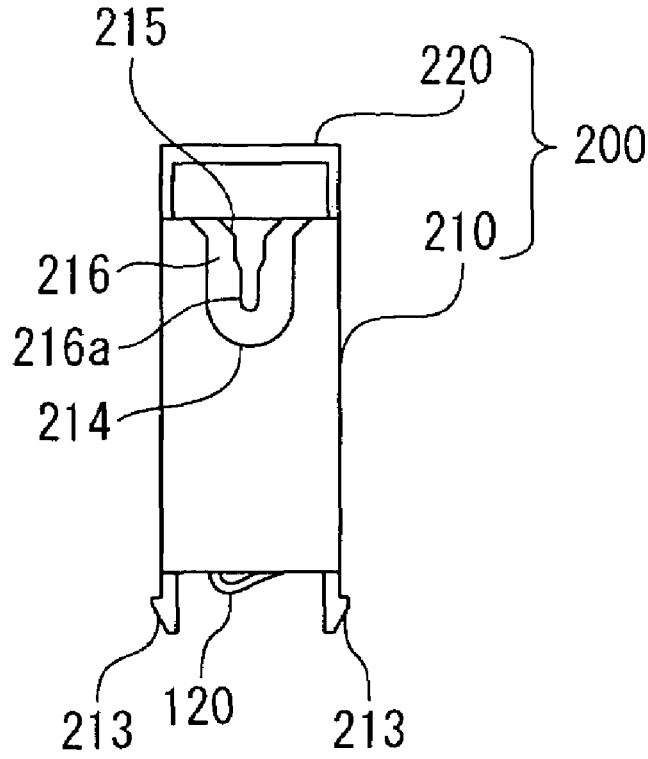
FIG. 11 is a schematic front view showing a design modification example of the body of the device.

Any design change to the body 200 is acceptable if it can accommodate the contact. Accordingly, although it has been described as a configuration of accommodating two contacts 100, it is only necessary to accommodate at least one, as shown in FIG. 11.

The engaging claw 213 may be of any type as long as it is provided on the edge part of the opening 212 of the body 200 and extends toward the protruding direction of the second connection part 120 and is capable of engaging with the substrate 20. Further, although the engaging claw 213 has been described to engage with the engaging hole of the substrate 20, it may be configured to engage with an end part or a groove part of the substrate 20, or to engage with another component provided on the substrate 20. Further, it is passable to form an engaging claw on the substrate 20 and form an engaged part on the body 200 for engaging with the engaging claw.

For the operation member 220, anything may be used if it can press the first and second bent parts 111*a* and 112*a*. For example, the body may have an opening positioned above the first and second bent parts 111*a* and 112*a*, which are pressed by the insertion of the operation member 220 in a rod shape.

Note that although the connecting device has been described as a socket for a cold cathode fluorescent lamp, it is not limited to this. It is needles to say that it is applicable to any other connecting devices such as a connector which electrically connects a lead terminal and a substrate.

What is claimed is:

1. A connecting device comprising:

a contact; and a body for accommodating the contact, the contact including a first connection part for connecting a lead terminal and a second connection part for connecting a substrate, wherein the first connection part of the contact has first and second clamp arms which are elastically deformable, the first and second clamp arms including:

first and second bent or curved parts which are bent or curved in directions away from each other; and first and second hold parts which are continued from tips of the first and second bent or curved parts and are bent or curved in directions opposite to the first and second bent or curved parts, wherein, when the first and second bent or curved parts of the first and second clamp arms are press-operated in directions approaching each other respectively, the first and second hold parts move in directions approaching each other and then basal end portions thereof intersect each other so as to form a space between distal end portions of the first and second hold parts for inserting the lead terminal from above, and when the first and second bent or curved parts are released from the press operation, the distal end portions of the first and second hold parts move in directions approaching each other so as to close the space, whereby the lead terminal is held between the distal end portions of the first and second hold parts, and wherein the body is provided above said space with an insertion hole for allowing insertion of the lead terminal into the space.

2. The connecting device according to claim 1, wherein the first clamp arm comprises two first clamp arms and are disposed on both sides of the second clamp arm.

3. The connecting device according to claim 1, wherein the second clamp arm comprises two second clamp arms and are disposed on both sides of the first clamp arm.

4. A connecting device comprising:

a contact; and a body for accommodating the contact, the contact including a first connection part for connecting a lead terminal and a second connection part for connecting a substrate, wherein the first connection part of the contact has a first clamp arm comprising a fixed piece, and a second clamp arm comprising an elastically deformable movable piece, the second clamp arm including:

a bent or curved part which is bent or curved in a direction away from the first clamp arm; and a hold part which is continued from a tip part of the bent or curved part and is bent or curved in a direction opposite to the bent or curved part, and wherein, when the bent or curved part of the second clamp arm is press-operated toward the first clamp arm, the hold part of the second clamp arm moves in a direction approaching the first clamp arm and then a basal end portion of the hold part intersects with the first clamp arm so as to form a space between a distal end portion of the hold part and the first clamp arm for inserting the lead terminal from above, and when the bent or curved part is released from the press operation, the hold part moves in a direction approaching the first clamp arm so as to close the space, whereby the lead terminal is held between the distal end portion of the hold part of the second clamp arm and the first clamp arm, and wherein the body is provided above said space with an insertion hole for allowing insertion of the lead terminal into the space.

5. The connecting device according to claim 4, wherein the first clamp arm comprises two first clamp arms and are disposed on both sides of the second clamp arm.

6. The connecting device according to claim 4, wherein the second clamp arm comprises two second clamp arms and are disposed on both sides of the first clamp arm.

7. A connecting device comprising:

a contact; and a body for accommodating the contact, the contact including a first connection part for connecting a lead terminal and a second connection part for connecting a substrate, wherein the first connection part of the contact has first and second clamp arms which are elastically deformable. the first and second clamp arms including:

first and second bent or curved parts which are bent or curved in directions away from each other; and first and second hold parts which are continued from tips of the first and second bent or curved parts and are bent or curved in directions opposite to the first and second bent or curved parts, wherein, when the first and second bent or curved parts of the first and second clamp arms are press-operated in directions approaching each other respectively, the first and second hold parts move in directions approaching each other and then intersect so as to form a space therebetween for inserting the lead terminal, and when the first and second bent or curved parts are released from the press operation, the first and second hold parts move in directions approaching each other so as to close the space, whereby the lead terminal is held between the distal end portions of the first and second hold parts, and wherein the body comprises:

a main body part for accommodating the contact; and an operation member which is provided movably to the main body part and is adapted, in accordance with movement thereof, to press the first and second bent or curved parts.

8. A connecting device comprising:

a contact; and a body for accommodating the contact.

the contact including a first connection part for connecting a lead terminal and a second connection part for connecting a substrate, wherein the first connection part of the contact has a first clamp arm comprising a fixed piece, and a second clamp arm comprising an elastically deformable movable piece, the second clamp arm including:

a bent or curved part which is bent or curved in a direction away from the first clamp arm;and a hold part which is continued from a tip part of the bent or curved part and is bent or curved in a direction opposite to the bent or curved part, and wherein, when the bent or curved part of the second clamp arm is press-operated toward the first clamp arm, the hold part of the second clamp arm moves in a direction approaching the first clamp arm and then intersects with the first clamp arm so as to form a space therebetween for inserting the lead terminal, and when the bent or curved part is released from the press operation, the hold part moves in a direction approaching the first clamp arm so as to close the space, whereby the lead terminal is held between the hold part of the second clamp arm and the first clamp arm, and wherein the body comprises:

a main body part for accommodating the contact; and an operation member which is provided movably to the main body part and is adapted, in accordance with movement thereof, to press the bent or curved part.

9. A connecting device comprising:

a contact; and a body for accommodating the contact, the contact includmnn a first connection part for connectmnn a lead terminal and a second connection part for connectina a substrate, wherein the first connection part of the contact has first and second clamp arms which are elastically deformable, the first and second clamp arms including:

first and second bent or curved parts which are bent or curved in directions away from each other; and first and second hold parts which are continued from tips of the first and second bent or curved parts and are bent or curved in directions opposite to the first and second bent or curved parts, wherein, when the first and second bent or curved parts of the first and second clamp arms are press-operated in directions approaching each other respectively, the first and second hold parts move in directions approaching each other and then intersect so as to form a space therebetween for inserting the lead terminal, and when the first and second bent or curved parts are released from the press operation, the first and second hold parts move in directions approaching each other so as to close the space, whereby the lead terminal is held between the distal end portions of the first and second hold parts, and wherein the body comprises:

an opening allowing the second connection part of the contact to protrude so as to contact a circuit pattern of the substrate; and an engaging claw being provided at an edge of the opening and extending toward a protruding direction of the second connection part for engaging with the substrate.

10. The connecting device according to claim 9, wherein the second connection part of the contact is in such a shape as to elastically contact the circuit pattern of the substrate.

11. The connecting device according to claim 9, wherein the second connection part of the contact is linearly shaped as to be inserted into a through hole of the substrate.

12. The connecting device according to claim 9, wherein the second connection part of the contact is in such a shape as to pressure-bond a lead wire thereto.

13. A connecting device comprising:

a contact; and a body for accommodating the contact, the contact including a first connection part for connecting a lead terminal and a second connection part for connecting a substrate, wherein the first connection part of the contact has a first clamp arm comprising a fixed piece, and a second clamp arm comprising an elastically deformable movable piece, the second clamp arm including:

a bent or curved part which is bent or curved in a direction away from the first clamp arm; and a hold part which is continued from a tip part of the bent or curved part and is bent or curved in a direction opposite to the bent or curved part, and wherein, when the bent or curved part of the second clamp arm is press-operated toward the first clamp arm, the hold part of the second clamp arm moves in a direction approaching the first clamp arm and then intersects with the first clamp arm so as to form a space therebetween for inserting the lead terminal, and when the bent or curved part is released from the press operation, the hold part moves in a direction approaching the first clamp arm so as to close the space, whereby the lead terminal is held between the hold part of the second clamp arm and the first clamp arm, and wherein the body comprises:

an opening allowing the second connection part of the contact to protrude so as to contact a circuit pattern of the substrate; and an engaging claw being provided at an edge of the opening and extending toward a protruding direction of the second connection part for engaging with the substrate.

* * * * *